US007956265B1

(12) United States Patent
Chen

(10) Patent No.: US 7,956,265 B1
(45) Date of Patent: Jun. 7, 2011

(54) POSITIONING DEVICE FOR A HOOP OF A DRUM

(76) Inventor: Kuo Chang Chen, Taichung (TW)

( * ) Notice: Subject to any disclaimer, the term of this patent is extended or adjusted under 35 U.S.C. 154(b) by 0 days.

(21) Appl. No.: 12/624,969

(22) Filed: Nov. 24, 2009

(51) Int. Cl.
*G10D 13/02* (2006.01)

(52) U.S. Cl. ..... 84/411 R

(58) Field of Classification Search ..... 84/411 R, 84/421
See application file for complete search history.

(56) References Cited

U.S. PATENT DOCUMENTS 7,262,356 B1 * 8/2007 Lukios, II ..... 84/422.1
* cited by examiner

*Primary Examiner* — Kimberly R Lockett

(57) ABSTRACT

A positioning device of the present invention is for fixing a relative position of a hoop of a drum and a pedal base, and it includes a main body, a clamping body, a first screw and an adjusting means. The main body is pivotably disposed on the pedal base, and the main body includes a front end and a rear end. The main body further has a threaded bore disposed at the front end along its longitudinal direction. The clamping body is disposed on the front end of the main body. The clamping body has a through hole corresponding to the threaded bore. The first screw inserts through the through hole to mate with the threaded bore. The clamping body is rotatable about the first screw. The adjusting means is for adjusting a height of the rear end of the main body.

4 Claims, 5 Drawing Sheets

POSITIONING DEVICE FOR A HOOP OF A DRUM

BACKGROUND OF THE INVENTION

1. Field of the Invention

The present invention relates to a positioning device for a hoop of a drum.

2. Description of the Prior Art

Generally speaking, a drum assembly includes a drum and a pedal system for a player to percuss the drum by foot. Some drum assemblies are provided with positioning devices to fix the relative position of the drum and the pedal system.

U.S. Pat. No. 5,185,489 and U.S. Pat. No. 7,408,104 disclose a positioning device mainly including a pivotable main body. A clamping body is disposed on a front end of the main body that can sway back and forth with respect to the main body, so as to clamp a hoop of a drum thereby.

U.S. Pat. No. 6,011,208 discloses a holding jaw having a waisted axial bore transversely disposed therein. As such, the holding jaw is swayable in two directions.

U.S. Pat. No. 6,331,666 discloses a main body having two lugs, each of which has a longitudinal slot vertically disposed thereon. As such, a clamping body thereof is also swayable in two directions.

Nevertheless, '208 and '666 does not provide a clamping body that can be fixed at a desired angle, thus the clamping body may not clamp the hood actively and tightly.

SUMMARY OF THE INVENTION

The main object of the present invention is to provide a positioning device whose clamping body can be fixed at a desired angle.

To achieve the above and other objects, a positioning device of the present invention includes a main body, a clamping body, a first screw and an adjusting means. The main body is pivotably disposed on the pedal base, and the main body includes a front end and a rear end. The main body further has a threaded bore disposed at the front end along its longitudinal direction. The clamping body is disposed on the front end of the main body. The clamping body has a through hole corresponding to the threaded bore. The first screw inserts through the through hole to mate with the threaded bore. The clamping body is rotatable about the first screw. The adjusting means is for adjusting a height of the rear end of the main body. As such, the clamping body is swayable and is selectively positioned at a desired angle as it is tightly clamped between the first screw and the main body.

The present invention will become more obvious from the following description when taken in connection with the accompanying drawings, which show, for purpose of illustrations only, the preferred embodiment(s) in accordance with the present invention.

BRIEF DESCRIPTION OF THE DRAWINGS

FIG. 1A is a perspective view showing an adjusting nut of the present invention;

DETAILED DESCRIPTION OF THE PREFERRED EMBODIMENTS

Figure 1:
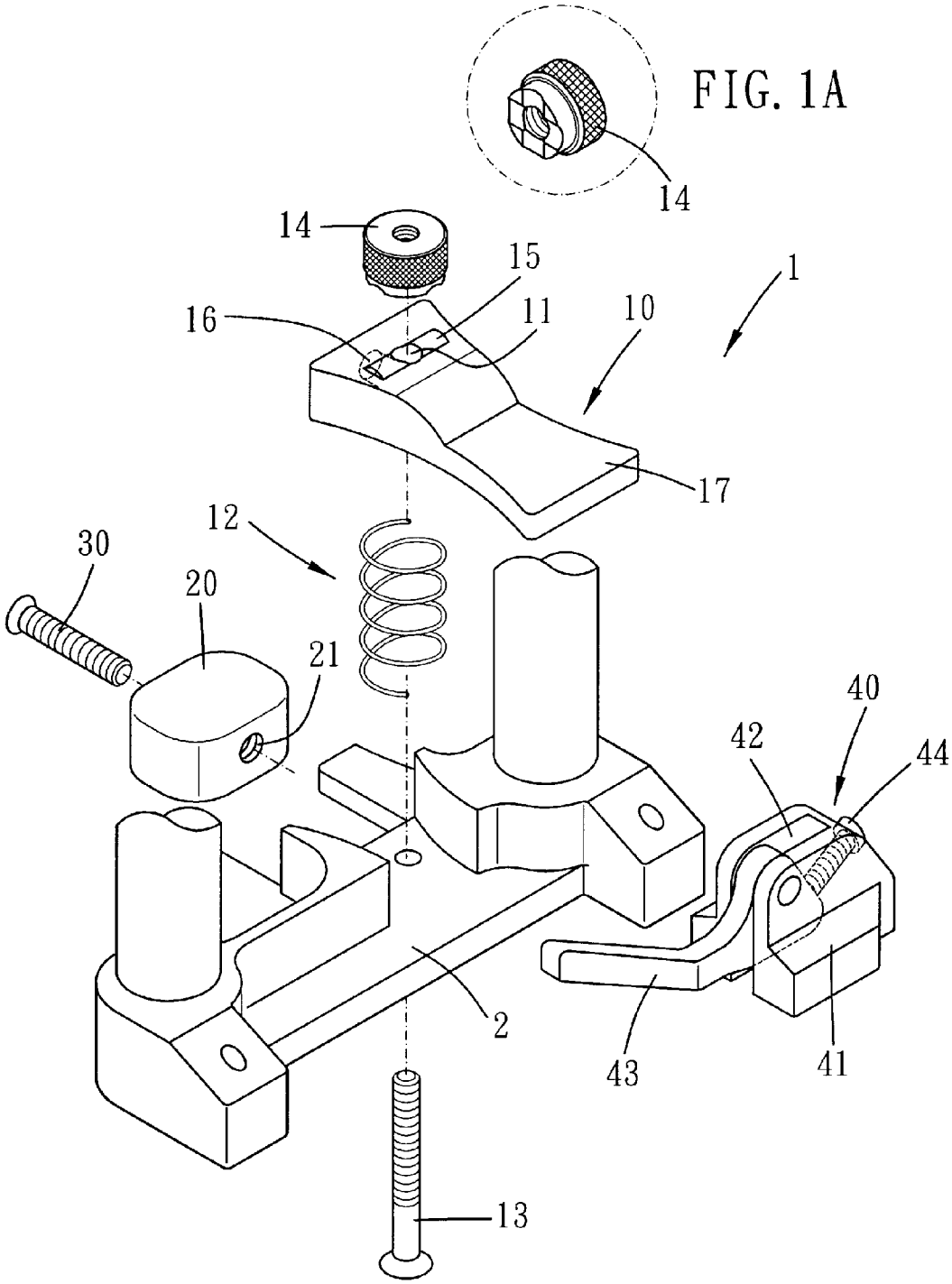
FIG. 1 is a breakdown drawing showing a positioning device of the present invention.
Figure 2:
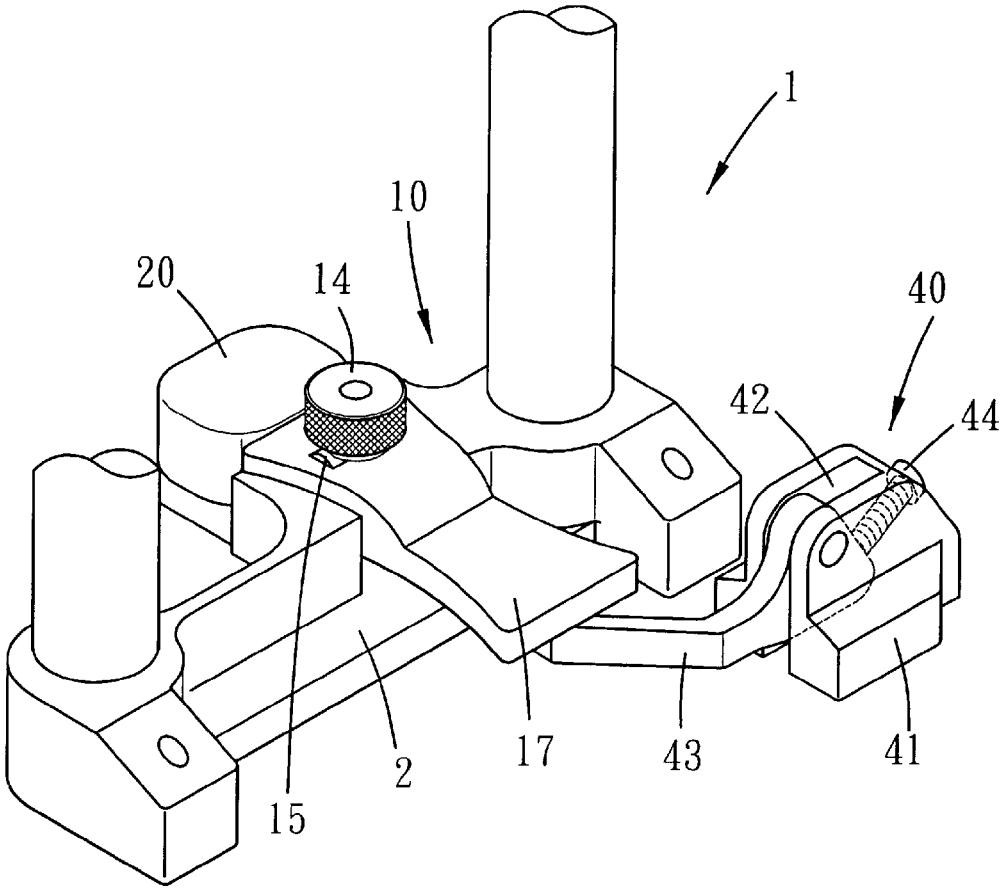
FIG. 2 is a combination drawing showing a positioning device of the present invention.
Figure 3:
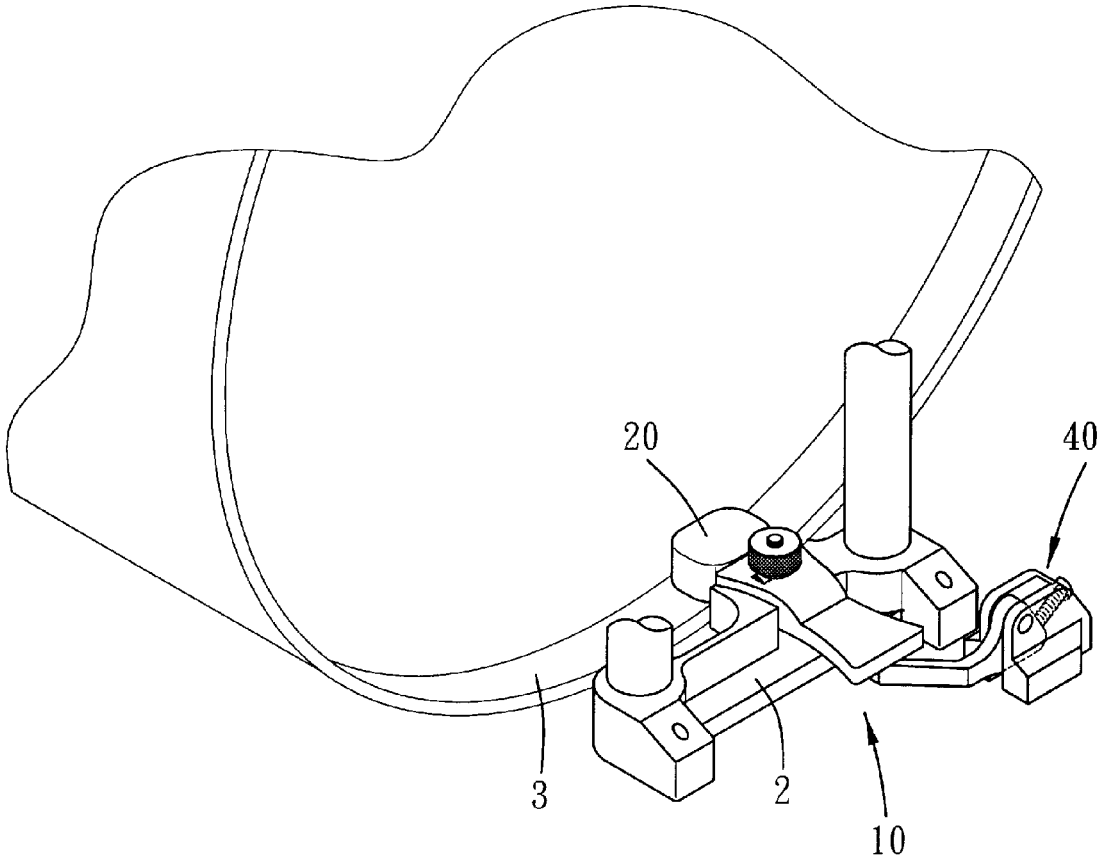
FIG. 3 is a perspective drawing showing a positioning device of the present invention.

Please refer to FIG. 1 to FIG. 3 for a preferred embodiment of the present invention. A positioning device 1 of the present invention is mainly for fixing a relative position of a hoop 3 of a drum and a pedal base 2 of a pedal system.

The positioning device 1 includes a main body 10, a clamping body 20, a first screw 30 and an adjusting means 40.

The main body 10 is pivotably disposed on the pedal base 2 and has a front end and a rear end 17. Preferably, the main body 10 has a main bore 11 substantially vertically penetrating the main body 10, a spring 12 is disposed between the main body 10 and the pedal base 2, and a second screw 13 inserts through the pedal base 2 and the main bore 11 to mate with an adjusting nut 14 disposed on the main body 10. Furthermore, the main body 10 has a protrusive arc surface 15 laterally disposed on a top surface thereof for the adjusting nut 14 to abut thereagainst. Specifically, a bottom surface of the adjusting nut 14 is formed with at least one concave groove corresponding to the arc surface 15, and the arc surface 15 can engage with the at least one concave groove. As shown in FIG. 1A, the adjusting nut 14 is provided with two concave grooves arranged in a cross shape. As such, the arc surface 15 engages with one of the concave grooves every quarter circle the adjusting nut 14 rotates. In addition, the main body 10 has a threaded bore 16 disposed at the front end. The threaded bore 16 is formed along a longitudinal direction of the main body 10.

The clamping body 20 is disposed on the front end of the main body 10, and the clamping body 20 has a through hole 21 corresponding to the threaded bore 16.

The first screw 30 inserts through the through hole 21 to mate with the threaded bore 16, such that the clamping body 20 is rotatable about the first screw 16.

The adjusting means 40 is for adjusting a height of the rear end 17 of the main body 10. In the present embodiment, the adjusting means 40 includes a base 41. The base 41 is formed with a slot 42 for an end of an arm 43 to pivotably dispose therein. The base 41 further has an adjusting screw 44 abutting against the end of the arm 43, so as to adjust a height of a distal end of the arm 43. Because the rear end 17 rests on the distal end of the arm 43, the height of the rear end 17 is thereby adjusted as well.

Or, the adjusting means may include a screw and a threaded bore vertically formed on the rear end 17. The screw threadedly engages with the threaded bore, and a distal end of the screw abuts against the pedal base 2 or the ground to adjust the height of the rear end 17.

Figure 4:
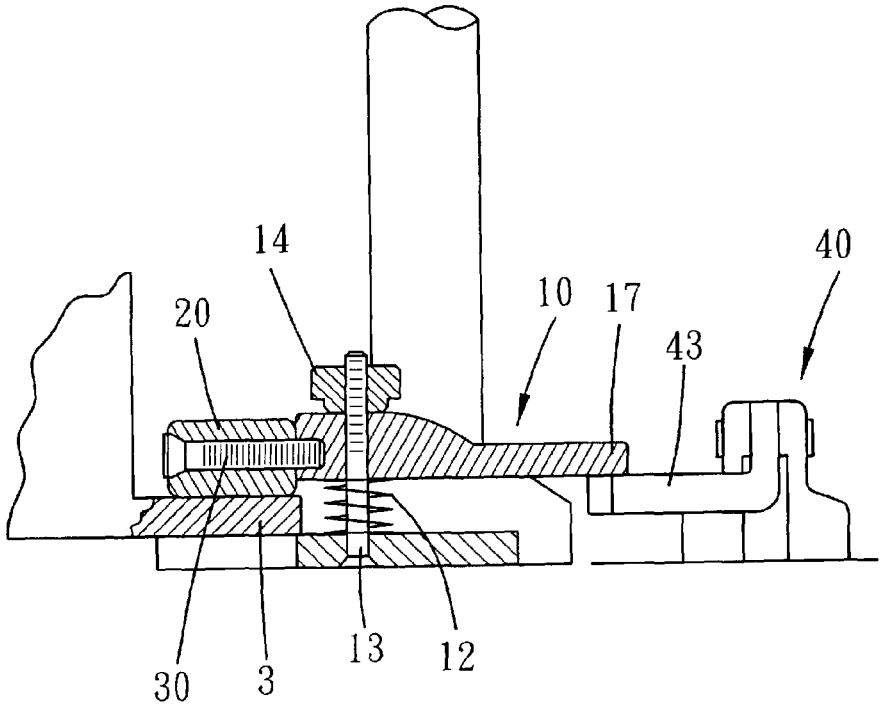
FIG. 4 is a profile showing a positioning device of the present invention.
Figure 5:
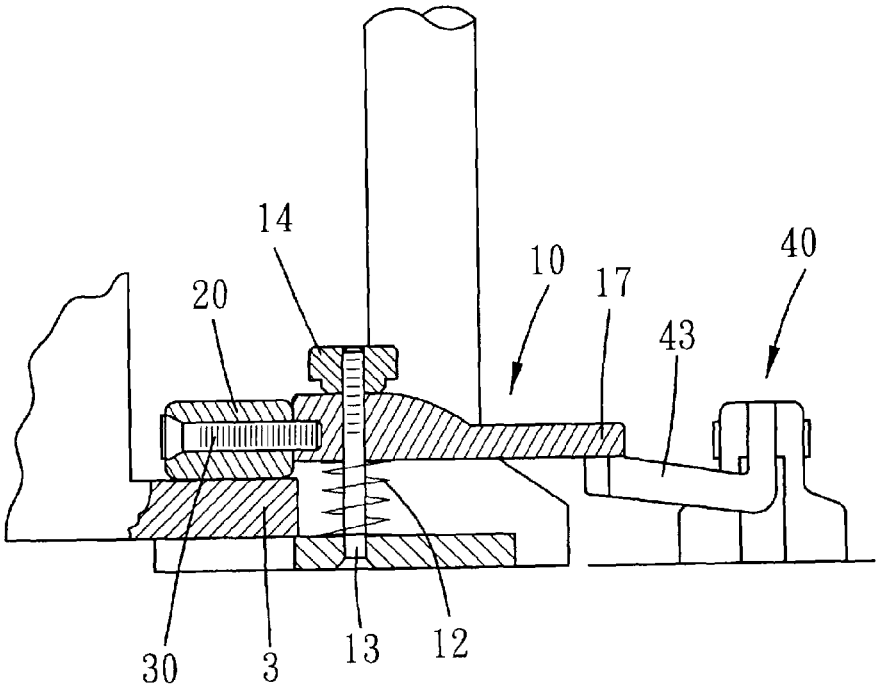
FIG. 5 is a profile showing a positioning device of the present invention.

Please refer to FIG. 4 and FIG. 5. In the present embodiment, the clamping body 20 is used to directly suppress the hoop 3. The height and the angle of the front end of the main body 10 can be varied by adjusting the height of the rear end 17 and by adjusting the height of the adjusting screw 14, so as to tightly suppress a hoop 3 with different thickness.

Figure 6:
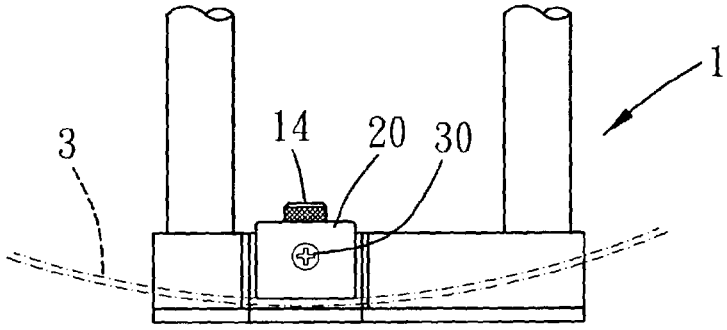
FIG. 6 is a front view showing a positioning device of the present invention.
Figure 7:
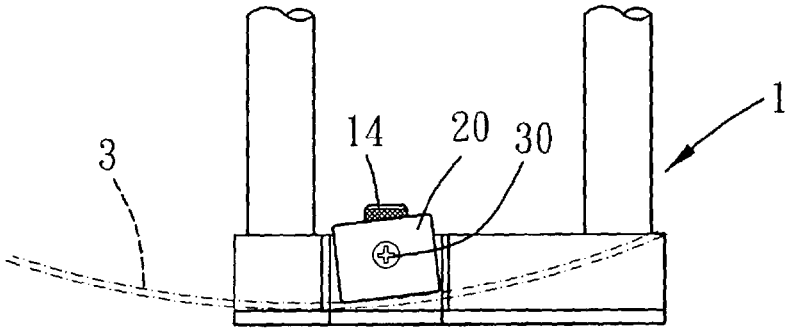
FIG. 7 is a front view showing a positioning device of the present invention.
Figure 8:
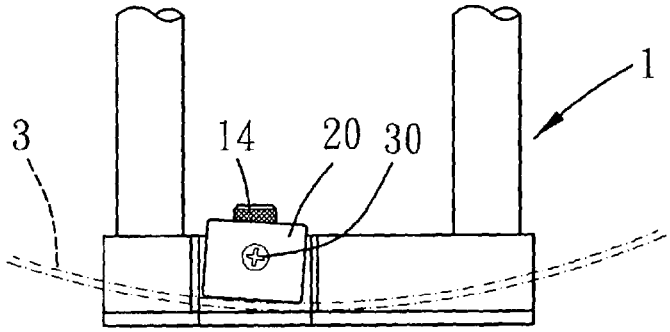
FIG. 8 is a front view showing a positioning device of the present invention.

Please refer to FIG. 6 to FIG. 8. In the present embodiment, the clamping body 20 is rotatable about the first screw 30. Thus the clamping body 20 is swayable and is positioned at a desired angle. As a result, the clamping body 20 of the present invention is adapted to suppress different positions of the hoop 3, so as to further fix the relative position of the hoop 3 and the pedal base 2 tightly.

In the prior embodiment, the clamping body 20 is used to directly suppress the hoop 3. However, the clamping body 20 can also be provided with another clamping pawl or the like. As such, the clamping body 20 can suppress the hoop 3 indirectly. In addition, the clamping pawl can be designed to be pivotable about the clamping body 20, so that the clamping pawl is swayable in two directions.

What is claimed is:

1. A positioning device for fixing a relative position of a hoop of a drum and a pedal base, comprising:

a main body, pivotably disposed on the pedal base, the main body comprising a front end and a rear end, the main body having a threaded bore disposed at the front end, the threaded bore being formed along a longitudinal direction of the main body;

a clamping body, disposed on the front end of the main body, the clamping body having a through hole corresponding to the threaded bore;

a first screw, inserting through the through hole to mate with the threaded bore, the clamping body being rotatable about the first screw;

an adjusting means for adjusting a height of the rear end of the main body.

2. The positioning device of claim 1, wherein a main bore substantially vertically penetrates the main body, a spring is disposed between the main body and the pedal base, a second screw inserts through the pedal base and the main bore to mate with an adjusting nut disposed on the main body.

3. The positioning device of claim 2, wherein the main body has a protrusive arc surface laterally disposed on a top surface thereof, the adjusting nut abuts against the arc surface.

4. The positioning device of claim 3, wherein a bottom surface of the adjusting nut is formed with at least one concave groove corresponding to the arc surface, the arc surface is engageable with the at least one concave groove.

* * * * *